US009849367B2

(12) United States Patent
Jones

(10) Patent No.: US 9,849,367 B2
(45) Date of Patent: Dec. 26, 2017

(54) ROTARY CARD SHUFFLING MACHINE

(71) Applicant: Mark Hamilton Jones and Sheryl Lynn Jones Family Trust date November 7, 2013, Gardnerville, NV (US)

(72) Inventor: Mark H. Jones, Gardnerville, NV (US)

(73) Assignee: Mark Hamilton Jones and Sheryle Lynn Jones Family Trust, Gardnerville, NV (US), dated Nov. 7, 2013

( * ) Notice: Subject to any disclaimer, the term of this patent is extended or adjusted under 35 U.S.C. 154(b) by 0 days.

(21) Appl. No.: 13/950,390

(22) Filed: Jul. 25, 2013

(65) Prior Publication Data

US 2013/0307216 A1 Nov. 21, 2013

Related U.S. Application Data

(63) Continuation-in-part of application No. 13/280,691, filed on Oct. 25, 2011, now Pat. No. 8,505,919, and a continuation-in-part of application No. 12/912,276, filed on Oct. 26, 2010.

(60) Provisional application No. 61/408,270, filed on Oct. 29, 2010, provisional application No. 61/255,128, filed on Oct. 27, 2009.

(51) Int. Cl.

| | |
|---|---|
| ***A63F 1/12*** | (2006.01) |
| ***A63F 1/00*** | (2006.01) |
| ***A63F 5/04*** | (2006.01) |

(52) U.S. Cl.
CPC ..... *A63F 1/12* (2013.01); *A63F 1/00* (2013.01); *A63F 5/045* (2013.01)

(58) Field of Classification Search
CPC ..... A63F 1/12
USPC ..... 273/149 R
See application file for complete search history.

(56) References Cited

U.S. PATENT DOCUMENTS

| | | | | |
|---|---|---|---|---|
| 508,834 | A * | 11/1893 | Pickens | 273/148 A |
| 2,077,124 | A * | 4/1937 | Miller et al. | 273/142 HA |
| 4,669,733 | A * | 6/1987 | Sweet | 273/150 |
| 4,697,364 | A * | 10/1987 | Dean | G09F 1/12 40/445 |
| 5,184,821 | A * | 2/1993 | Korenek | A63F 5/04 273/138.2 |
| 5,951,298 | A * | 9/1999 | Werzberger | G09B 1/00 281/15.1 |
| 2010/0327523 | A1* | 12/2010 | Owoc | A63F 5/04 273/142 R |

* cited by examiner

*Primary Examiner* — Michael Dennis
(74) *Attorney, Agent, or Firm* — John S. Artz; Dickinson Wright PLLC

(57) ABSTRACT

A rotary card shuffling and selection machine for use in playing a game of chance includes a wheel supported in a generally vertical plane for rotation about a horizontal rotary axis. The wheel is provided with a plurality of card positions arranged concentrically about the rotary axis. Each card position receives a card bearing indicia suitable to decide the game of chance. The cards are secured in card positions disposed around the wheel such they are oriented face up so that indica on the face of the card, which is relevant to the outcome of the game of chance, can be seen while the wheel is rotating.

18 Claims, 6 Drawing Sheets

ROTARY CARD SHUFFLING MACHINE

CROSS REFERENCE TO RELATED APPLICATIONS

This application is a Continuation-In-Part of U.S. patent application Ser. No. 13/280,691, filed Oct. 25, 2011, entitled "Rotary Card Shuffling Machine", which application claims priority to U.S. Provisional Patent Application Ser. No. 61/408,270 filed Oct. 29, 2010, entitled "Vertical Card Shuffling Machine", and this application also is a Continuation-In-Part of U.S. patent application Ser. No. 12/912,276, filed Oct. 26, 2010, entitled "Casino Card Game", which claims priority to U.S. Provisional Patent Application Ser. No. 61/255,128, filed Oct. 27, 2009, entitled "Mystery Card Bonanza", the entire disclosures of which are hereby incorporated by reference and relied upon.

TECHNICAL FIELD

This invention relates generally to a card shuffling and selection machine for a game of chance, and more particularly to a rotary card shuffling and selection machine supported for rotation where the indicia of the cards are visible while the machine is rotating.

BACKGROUND OF THE INVENTION

The games of Money Wheel and Big Six are well established casino games including a "prize-wheel" type of random point generating device in the form of a large vertical rotating wheel. The playing wheel is imprinted with a plurality of fixed symbols along its circumference. By use of the term "fixed" here to refer to the symbols, it is meant that the symbols are imprinted on the wheel at the factory and cannot be rearranged or their relative positions manipulated in any reasonable way. A nearby player betting surface presents a plurality of wagering areas corresponding to the fixed symbols on the playing wheel. Each round of the game starts with the players placing wagers on the wagering areas. Once all of the wagers are placed, a dealer manually spins the playing wheel, and a winning symbol is determined by a fixed pointer once the playing wheel comes to a stop. Wagers previously placed on the wagering area associated with the winning symbol are deemed "winners" and paid according to a predetermined pay-out.

Gaming laws vary greatly from one jurisdiction to the next throughout the United States. Consequently, many jurisdictions significantly restrict the playing of dice and wheel casino games. Wheel games are generally restricted in those jurisdictions if they have a moving random number or result generation wheel with indicia being fixed in a permanent manner to the wheel itself. Again, use of the term "fixed" here refers to the indicia being imprinted on the wheel at the factory and not realistically capable of being rearranged by a casino. It does not matter whether the wheel operates in a vertical fashion, like the above-described prize wheel, or in a horizontal position, like a roulette wheel. The key is that the indicia for that apparatus must always be in the same position of the wheel for the game to be considered restricted. For example, with some wheels, the 0 and 00 are always fixed to the same spot on a single or double roulette wheel, and the 40 to 1 indicia is always fixed to the same location on a "Money Wheel."

In addition to being restricted in many jurisdictions, fixed indicia wheel games present two additional problems. The first problem is that wheels may be rigged, or "gaffed", to generate a preferred outcome. The second problem is that any misbalance in the wheel will favor one outcome over another. New devices have been created that allow cheaters to determine whether a wheel is out of balance, and if so, what outcome has an increased expectation of appearing. Cheaters then use this information to their advantages when placing wagers.

U.S. Pat. No. 7,669,853, issued to Mark H. Jones (hereinafter referred to as "Jones '853 patent"), shows a horizontally mounted wheel for use in wheel games, e.g. roulette. Rather than having fixed indicia on the wheel, which is not only restricted in many jurisdictions, but also easy for cheaters to crack, the wheel of the Jones '853 patent uses a variable indicia system in the form of removable and reorderable playing cards. The playing cards are disposed around the circumference of the playing wheel, and a flapper is used to determine the winning card. The playing cards are periodically removed from the shuffler machine and rearranged between rounds by the casino, thus varying the positions of the indicia. The wheel of the Jones '853 patent is designed to randomly generate a winning card, or cards, from a mix of cards, and as such may be used for several different games, including dice games like craps. The key to its overwhelming legal acceptance, even in jurisdictions where other types of wheel games are prohibited, has been that the cards are periodically removed, shuffled, and returned to the machine based on the casino's policies and procedures. In other words, the cards are not fixed forever in a specified slot, but rather periodically randomly relocated into different slots between games. The variable position of the indicium negates any advantage a cheater might gain from knowledge of a biased wheel. The wheel of the Jones '853 patent is not operable in a vertical position, however, because the cards would too easily fall out of the apparatus during the spinning (shuffling) process. Also, as the wheel rotates, the card indicia are not visible to players until the cards are removed from their respective slot.

U.S. Pat. No. 3,841,637 to Piazza et al. discloses a card wheel type device in which cards may be placed in a horizontally rotatable platter via respective card receptacles and support members fitted each with a clamp section. Like the Jones '853 wheel, the Piazza device is also particularly ill-suited for operation in the vertical "prize wheel" dimension because its cards would not be properly retained in the slots when the wheel is rotated. Any cards slipping loose from the open-end slots in Piazza would create a catastrophic event bringing game play to a halt and jeopardizing the trust and integrity players must possess toward the operators of a game of chance.

There is therefore a need in the art for an improved "prize wheel" type device which can accommodate the variable indicium features of the Jones '853 patent. Such a vertically oriented wheel must reliably hold cards on the wheel without risk of loss, yet permit convenient removal and replacement of such cards at the end of each spin in order to render a game decision.

SUMMARY OF THE INVENTION

It is therefore an aspect of the present disclosure to provide a rotary card shuffling machine that utilizes actual cards.

It is another aspect of the present disclosure to provide a rotary card shuffling machine where the cards can be randomly dispersed in slots about the machine before each spin of the wheel.

It is still another aspect of the present disclosure to provide a rotary card shuffling machine where the indicia of each card is visible to players as the wheel spins.

It is a further aspect of the present disclosure to provide a rotary card shuffling machine that yields increased player enjoyment.

In accordance with the above and the other aspects of the present disclosure, a rotary card shuffling and selection machine is provided. The machine includes a support structure and an axle that extends generally perpendicularly from the support structure for establishing a rotary axis. A wheel is supported on the axle for rotation about the rotary axis. The wheel has a front face with a plurality of card positions the number of which is predetermined. Each of the card positions includes a card retention mechanism to retain the card to the front face of the wheel in a face up orientation. The card positions are disposed in equal circumferential increments about the rotary axis. A plurality of cards are provided, the total number of which is equal to the predetermined number of card positions. One card is placed in removable communication with each of the card retention mechanism such that all of the card positions are filled with cards. Each card bears indicia suitable to decide the outcome of a game of chance. The cards are retained to the wheel such that their indicia can be seen as the wheel is spinning.

The subject rotary card shuffling and selection machine provides a new and improved type of prize wheel device suitable for play of games such as Money Wheel and Big Six as well as many other and new games of chance. One aspect of the present machine is that the cards can be periodically rearranged and placed in the respective card positions in a new order thereby making it very difficult for players to predict an outcome using the skill of wheel tracking or knowledge of a mechanical bias. Furthermore, the subject machine substantially impedes the possibility for improper collusion between the dealer and players. The subject machine neatly retains cards in the respective card positions as the wheel is rotated without allowing the cards to become dislodged, but yet the cards remain easily removable for a game decision and then returned to the card position for continued play.

BRIEF DESCRIPTION OF THE DRAWINGS

These and other features and aspects of the present disclosure will become more readily appreciated when considered in connection with the following detailed description and appended drawings, wherein.

DETAILED DESCRIPTION OF THE PREFERRED EMBODIMENT

Figure 1:
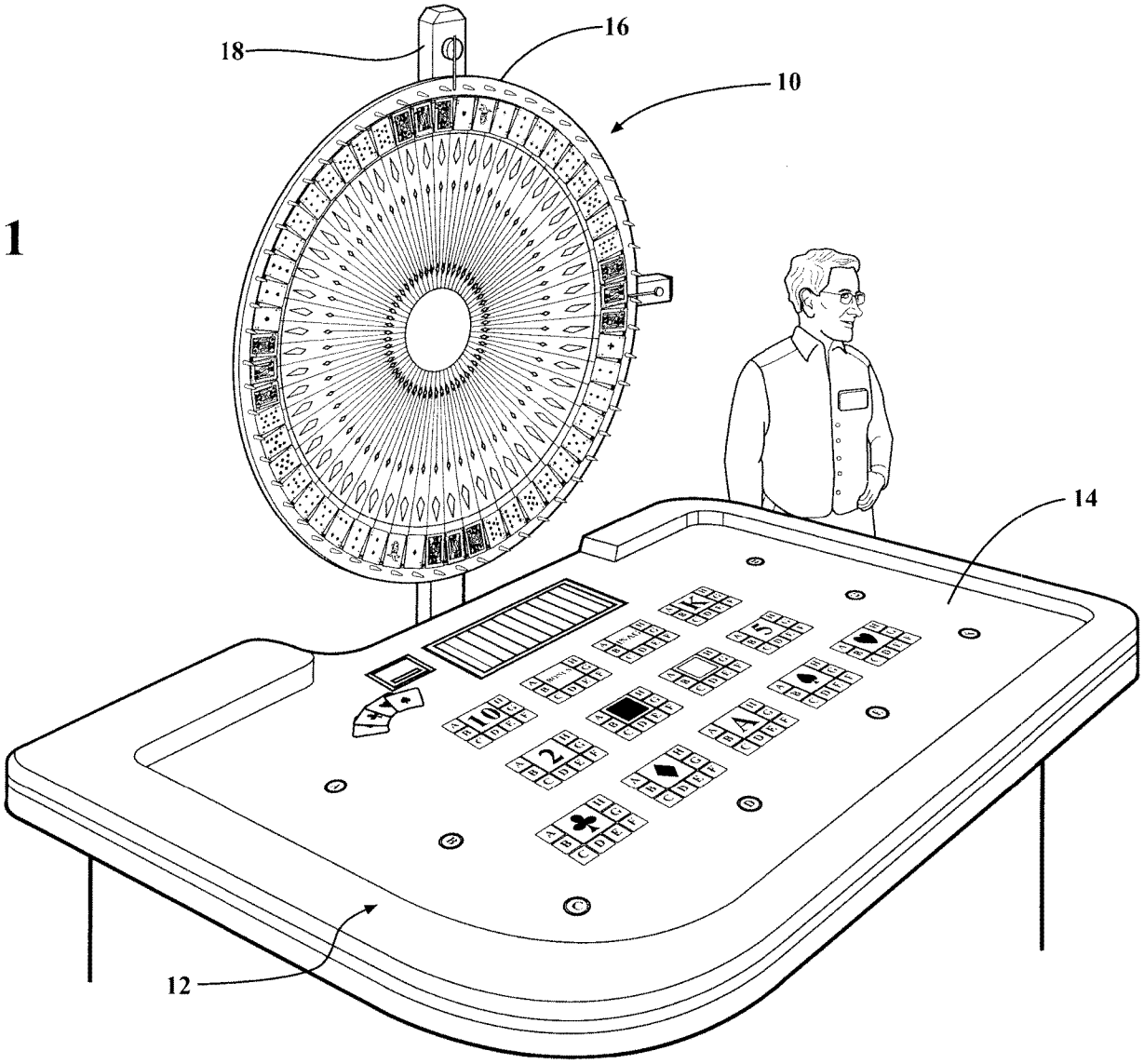
FIG. 1 is a perspective view of an exemplary casino-type game of chance played with a rotary card shuffling machine according to an aspect of the present disclosure.

Referring to the Figures, wherein like numerals indicate like or corresponding parts throughout the several views, a simplified depiction of a live game of chance is generally shown at 10 in FIG. 1 according to an aspect of the disclosure. The game of chance 10 is intended to represent any type of game that may be played according to the teachings of the present disclosure. Such games may include, but are by no means limited to, the games of Money Wheel and Big Six. In addition, the game of chance 10 may include future developed games suitable for play using the teachings of this disclosure. Although the illustration in FIG. 1 shows a physical table 12 having a horizontal playing surface 14 around which players (not shown) congregate to place wagers, it will be understood that electronic implementations of the game of chance 10 are possible without departing from the spirit and scope of this disclosure. In particular, in electronic versions, the playing surface 14 may be displayed via a monitor or projector (not shown) on one or more terminals in the same or in geographically disperse locations. According to another aspect, both a physical table and an electronic version of a table may be employed in connection with a single game of chance.

Figure 2:
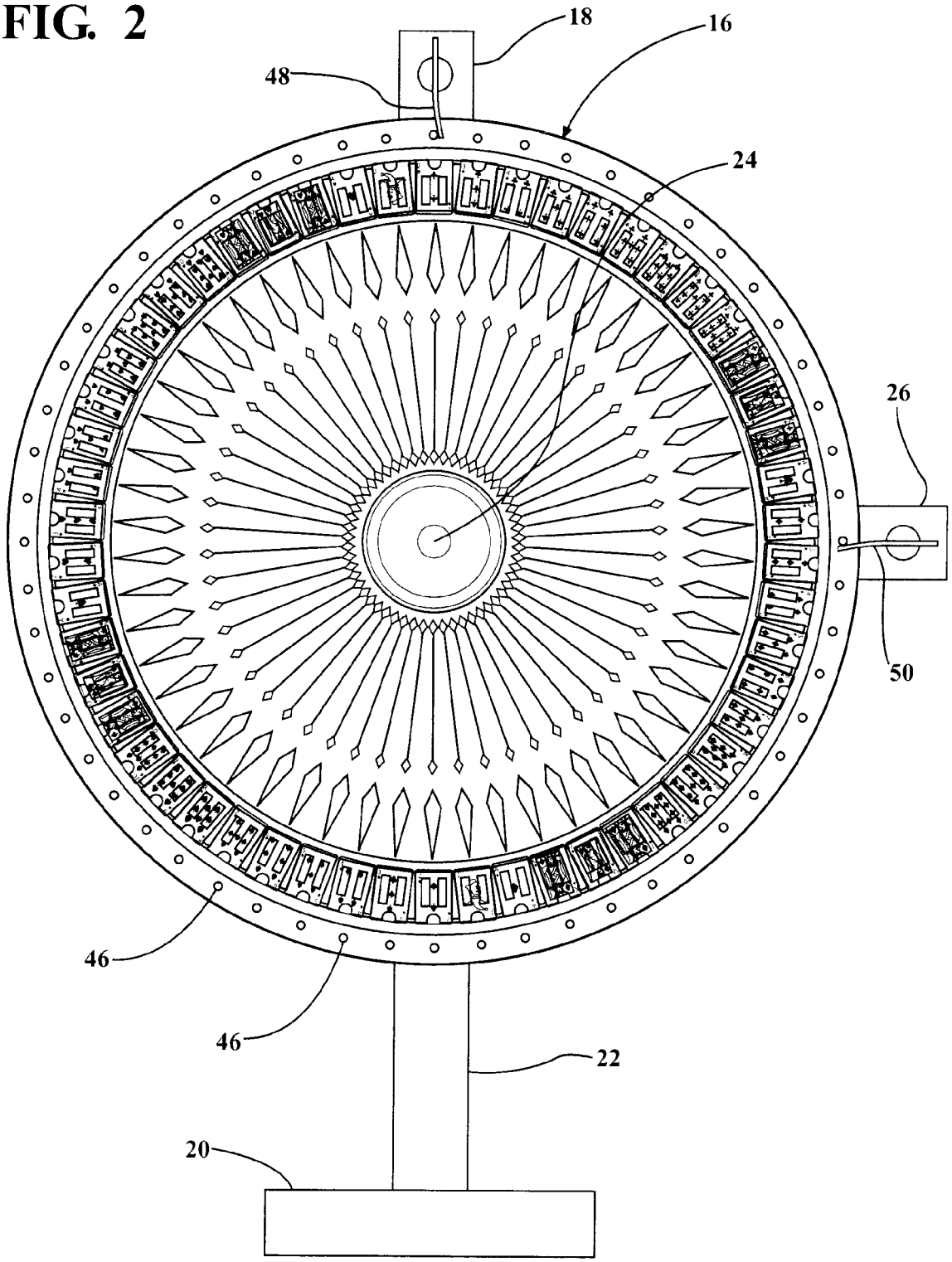
FIG. 2 is a front elevation of a rotary card shuffling machine according to an aspect of the present disclosure.

A card shuffling and selection machine according to an aspect of the present disclosure is generally shown at 16. The card shuffling machine 16 may be used in conjunction with a game of chance 10 to randomly generate a game winning decision during each round of play. The card shuffling machine 16 can include a support structure, generally indicated at 18, which is stable and sturdy. The support structure 18 is best shown in FIGS. 1 and 2 including a base 20 for engaging a floor surface. The base 20 may take many forms including separated feet, anchored posts, or a flat, plate-like member as shown for providing stable purchase against the floor. An upright shaft 22 can extend generally vertically upwardly from the base 20. Naturally, the upright shaft 22 may take many forms and may even be configured in such a way as to not appear shaft-like in nature. For example, the upright shaft 22 may instead take the form of a cabinet, a framework, a wall, or any other suitable structure anchored sufficiently to the base 20 (or other floor structure) so as to provide sturdy support. The support structure 18 can further include an axle 24. According to an aspect, the axle 24 can extend generally perpendicularly from the upright shaft 22 for establishing a generally horizontal rotary axis A. In alternative configurations, the axle 24 may be attached directly to a wall surface, cabinet, framework or other type of configuration comprising a support structure 18, all within the contemplated embodiments of this disclosure. The support structure 18 in this exemplary embodiment includes an optional side arm 26 extending generally perpendicularly from the upright shaft 22 and generally perpendicularly intersecting the rotary axis A. The axle 24 and the side arm 26 may be, as depicted, in the illustrated embodiment, vertically aligned with one another. Naturally, in other design expressions of the support structure 18, the side arm 26 may be configured substantially differently or even omitted altogether.

According to an aspect, the card shuffling machine 16 may further include a wheel, generally indicated at 28. The exemplary wheel 28 is perhaps best shown in FIGS. 1-3 in its entirety and supported on the axle 24 for free spinning rotation about the horizontal rotary axis A. According to an aspect, the wheel 28 can include a journal, socket or other bearing component to receive the axle 24 so that the wheel 28 can be rotated about the rotary axis A without the aid of a motor or power input (other than human muscle power). Naturally, other rotating connection configurations can be envisioned wherein the male portion of the axle 24 is mounted to the wheel 28 directly and a female socket is formed in the support structure 18. Alternatively, respective rotary bearing members may be attached to the support structure 18 and the wheel 28 to affect a similar rotating relationship. In any event, the wheel 28 may be journaled with low friction bearing elements, grease or other good sliding arrangements so that, when spun manually by an operator, the wheel 28 will freely spin and progressively slow until coming to rest.

Figure 3:
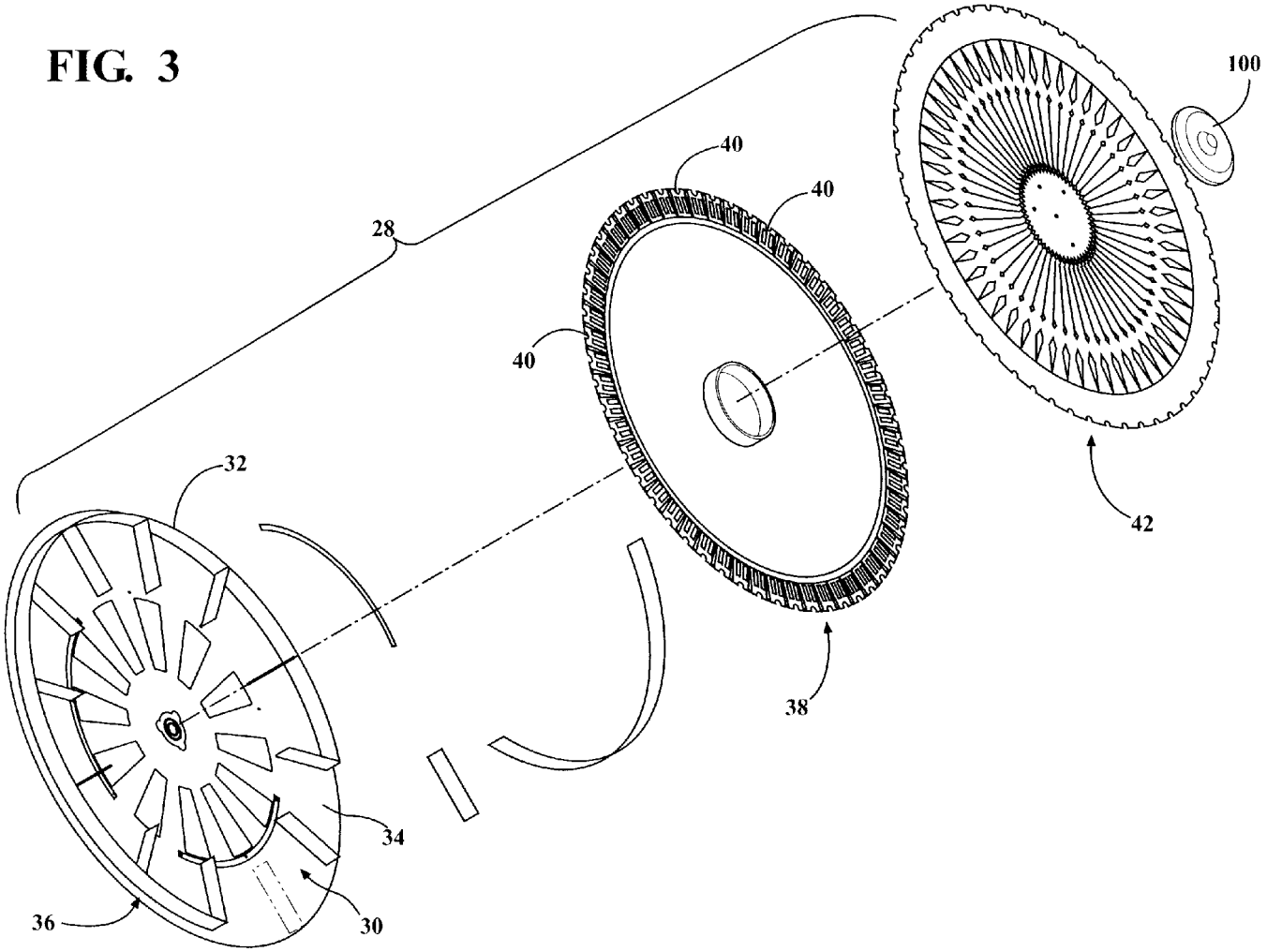
FIG. 3 is an exploded view of the rotary card shuffling machine of FIG. 2.

As shown best in FIG. 3, the wheel 28 can include a hub section 30 that engages the axle 24. According to another aspect, the hub section 30 has a front face 34 and a back face 36. In use, the front face 34 may be disposed toward the game table 12 such that it is visible to players of the game of chance 10. According to an aspect, the back face 36 faces the support structure 18. According to another aspect, an annular ring 38 may be secured to the front face 34 of the wheel 28 adjacent the outer rim 32 of the wheel 28. The annular ring 38 may include a plurality of card positions 40 for receiving individual cards on the wheel 28 in a face up orientation. According to an aspect, the annular ring 38 may be an integral structure formed of a plastic material. Alternatively, the annular ring 38 may take on a variety of different configurations and may be formed from a variety of different materials. The annular ring 38 may also be located in various places on the wheel 28. According to still a further aspect, a decorative cover 42 may be secured to the front face 34 of the hub section 30. The decorative cover 42 may fit within the annular ring 38 or may overlie the annular ring 38 and thus overlie the card positions 40. According to still another aspect, the decorative cover 42 may have a variety of different graphics thereon depending upon the game being played. The decorative cover 42 may also be formed of a variety of different materials and may take on various different shapes and sizes. According to an aspect, a plate 100 may help secure the decorative cover 42 and the annular ring 38 to the hub section 30. Other attachment methods may also be employed.

It will be appreciated that the wheel 28 could have a variety of different configurations. According to another aspect, the wheel 28 could be configured for horizontal rotation about a vertical axis. According to a further aspect of the disclosure, the wheel 28 could be in communication with a computer and/or motor such that the wheel could spin under power of the motor and the spinning and stopping of the wheel could happen automatically under computer control.

According to a further aspect and as discussed above, the hub section 30 can include a plurality of card positions 40 disposed therearound. According to an aspect, the card positions 40 may consist of a designated area on the hub section 30 that is configured to receive and retain a card during play of the game of chance. The card positions 40 may have a variety of suitable configurations, including as discussed herein. The total number of the card positions 40 may comprise a predetermined number which may vary depending on the type of game played. For example, if the card shuffling machine 16 is used to play a game similar to or according to the traditional rules of roulette, the predetermined number of card positions 40 may be thirty-seven if playing European style with only one "0". However, the predetermined number may be thirty-eight if playing American style roulette that includes both "0" and "00". If playing a game similar to the game of craps, the predetermined number of card positions 40 may be thirty-six representing the thirty-six possible outcomes of two rolled dice. Naturally, other games may require a different number of predetermined card positions 40. According to one aspect, at the time of manufacture, the wheel 28 is formed with the predetermined number of card positions 40. Therefore, a different wheel 28 may be required to play different games of chance. Alternatively, the wheel 28 could be reconfigured at a casino or the like to allow different games to be played on the same wheel. The plurality of card positions 40 may be disposed in equal circumferential increments about the rotary axis A. Therefore, the arcuate spacing (in degrees) from one card position 40 to the next adjacent card position 40 (center-to-center) is generally equal to the number 360 divided by the predetermined number of card positions 40. So, if the predetermined number is thirty-six, the equal circumferential increment between each card position 40 is 10 degrees. If the predetermined number of card positions 40 is fifty-four, the spacing between card position 40 (center-to-center) is approximately 6.7 degrees. Likewise for any predetermined number.

According to an aspect, the wheel 28 may also include a plurality of dividers 46. The total number of dividers 46 can equal the predetermined number of card positions 40. Therefore, if the predetermined number of card positions 40 is sixty-two, then there are sixty-two dividers 46. In the illustrated embodiment, each divider 46 may extend axially from the front face 34 of the hub 30. The dividers 46 may be disposed in equal circumferential increments about the rotary axis A, and may be arranged in generally equal radial spacing from the rotary axis A so as to appear in a ring or circular pattern centered about the rotary axis A. According to another aspect, the dividers 46 may comprise cylindrical pegs having generally equal axial lengths as perhaps best shown in FIG. 3. The dividers may take on a variety of different configurations or be omitted altogether.

According to a further aspect, the wheel 28 may include a first flapper 48 is supported by the upright shaft 22 adjacent the wheel outer rim 32. As shown in FIGS. 1 and 2, the first flapper 48 may be disposed in a twelve o'clock position by reference to a standard watch face. Relocation of the first flapper 48 to another position, however, is of course possible. The first flapper 48 may also be secured in a variety of other suitable ways. The first flapper 48 may comprise a resilient paddle made from rubber, leather, or other spring-like material extending into an interference position relative to the dividers 46 so that when the wheel 28 is spun about the rotary axis A, the dividers 46 will sequentially strike and displace the resilient paddle 48 thereby progressively slowing the spinning wheel 28. It will be appreciated that a flapper or other stopping mechanism may be omitted entirely and the wheel 38 rotation could be stopped and stopped automatically under computer control.

Likewise, a second flapper 50 may be supported by the side arm 26 adjacent the outer rim 32 of the wheel 28. In this condition, and according to the illustrated embodiment, the second flapper 50 is disposed in a three o'clock (or nine o'clock) position relative to the rotary axis A. The second flapper 50 may be formed substantially identical to the first flapper 48 in that a resilient paddle-like element extends into an interference position relative to the dividers 46 to progressively slow the spinning wheel by sequential strikes. Although the machine 16 can be played with only a single flapper, use of two flappers 48, 50 will result in quicker deceleration of the spinning wheel 28 and therefore a quicker game decision. One of the first 48 and second 50 flappers comprises a pointer. This, for example, may be ideally suited to the second flapper 50 which may be located at a height that is more accessible to an average-size human being standing on the floor as shown in FIG. 1. Thus, the second flapper 50 can point to and designate one of the card positions 40 and in particular the most closely proximate card position 40 after the wheel 28 has come to rest following a manual spin.

The card shuffling machine 16 further includes a plurality of cards 52. The cards 52 may be standard playing cards such as used for the games of blackjack and poker, or may be manufactured to custom specifications. The total number of cards 52 is equal to the predetermined number of card positions 40 so that one card 52 is disposed in each card position 40. For example, if a game similar to craps is being played and the predetermined number of card positions 40 is thirty-six, then thirty-six cards 52 will be provided, each imprinted with indicia 54 representing the thirty-six possible outcomes of two rolled dice. Therefore, whatever game of chance 10 is being played with the machine 16, the cards 52 bear indicia 54 suitable to decide the outcome of that game of chance 10.

According to an aspect, each card position 40 may include a card retention mechanism to hold the card 52 centered and securely in the card position 40 when the wheel 28 is spun. According to another aspect, the card retention mechanism can retain the card in face up position such that indicia 54 of the card 52 can be seen as the wheel 28 is rotating. In operation, whenever a pointer (e.g., the second flapper 50) or other card identifying device comes to indicate a particular card 52 in card positions 40, the operator can easily remove the card 52 from the card retention mechanism. This allows the operator to announce the indicia 54 on the card 52 and thereby decide the game of chance 10 (or at least a portion of the game).

Figure 4:
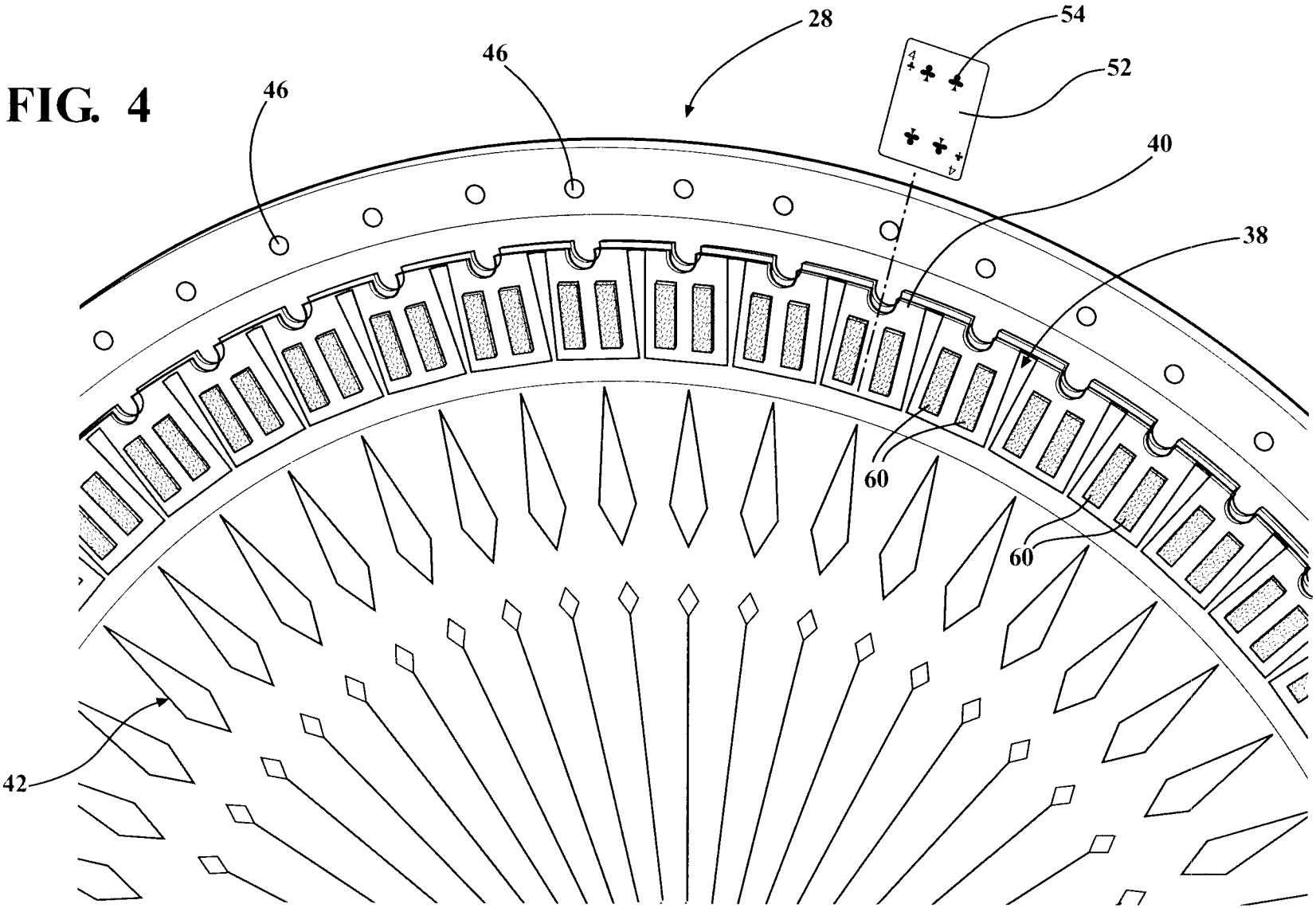
FIG. 4 is an enlarged view of a portion of the rotary card shuffling machine illustrating the insertion of a card into a card position according to an aspect of the disclosure.
Figure 5:
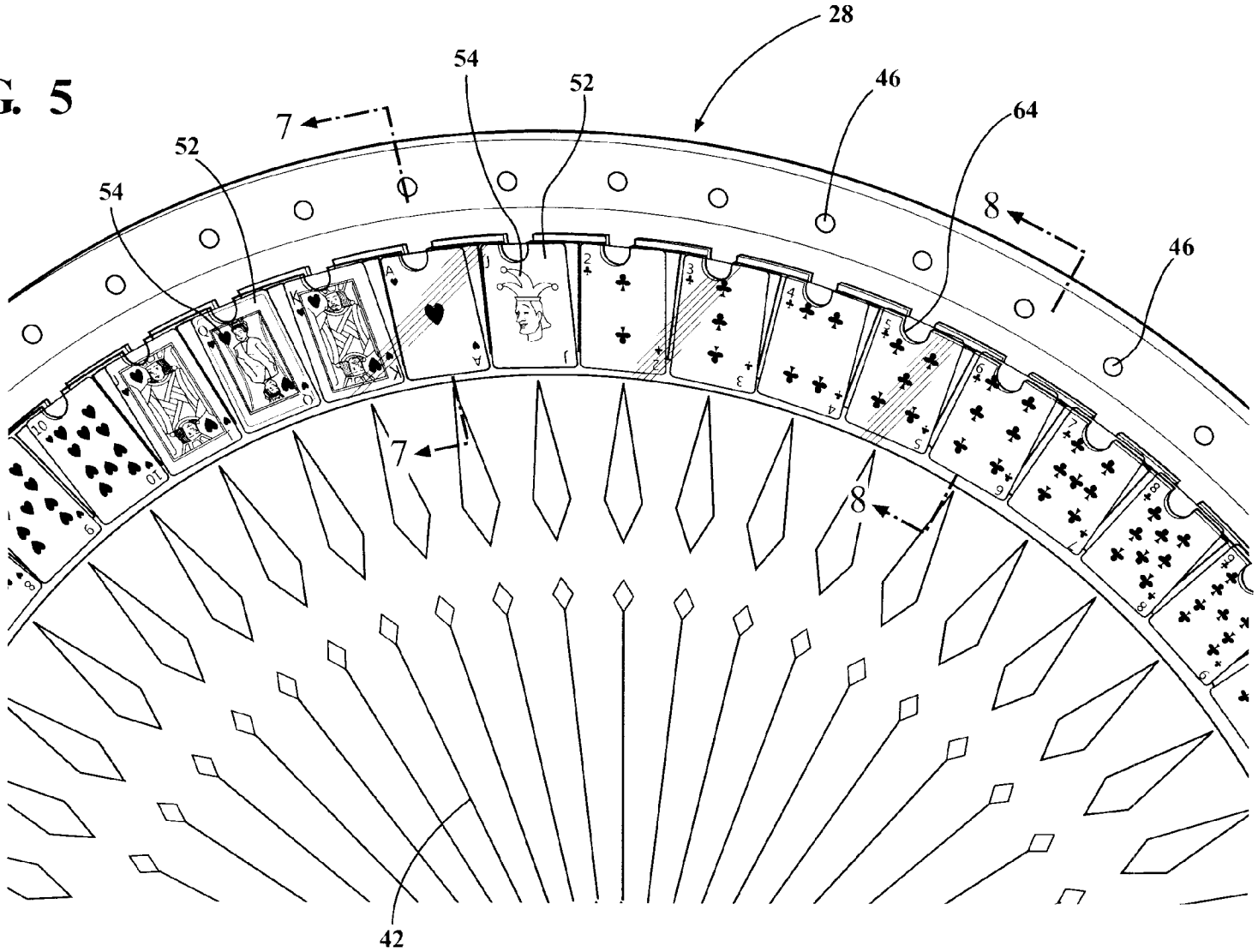
FIG. 5 is an enlarged view of a portion of the rotary card shuffling machine illustrating a plurality of cards in card positions in accordance with an aspect of the disclosure.
Figure 6:
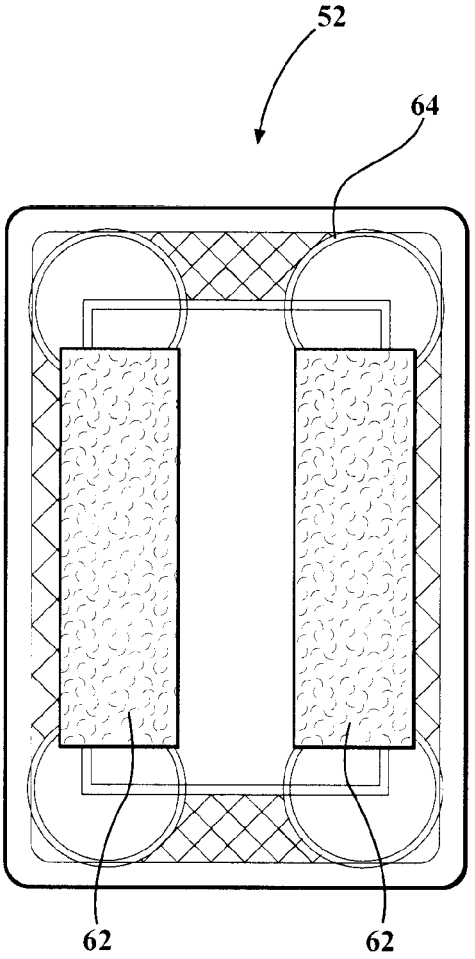
FIG. 6 is a rear view of a card showing an exemplary retention mechanism in accordance with an aspect of the disclosure.

As shown in FIG. 4, the card positions 40 may consist of slots formed between the annular ring 38 and the decorative cover 42. Each of the slots may include one or more hook and loop strips 60 that engage respective hook and loop strips 62 on the back side 64 of each card 52 (FIG. 6). The engagement of the hook and loop strips 62 on the cards 52 with the hook and loop strips 60 in the card slots serves to firmly secure the cards 52 to the wheel 28 while the wheel 28 is spinning. Each slot may be formed with a notch 64 that allows an operator or dealer to access the card and remove it from the slot or card position 40. According to an aspect, the decorative cover 42 and/or the annular ring 38 are formed of a transparent material such that the indicia 54 of each card 52 can be seen while the wheel 28 is rotating. FIG. 4 illustratively illustrates the insertion of a card into its respective card position 40. FIG. 5 illustrates a plurality of cards 52 in their respective card positions 40.

Figure 7:
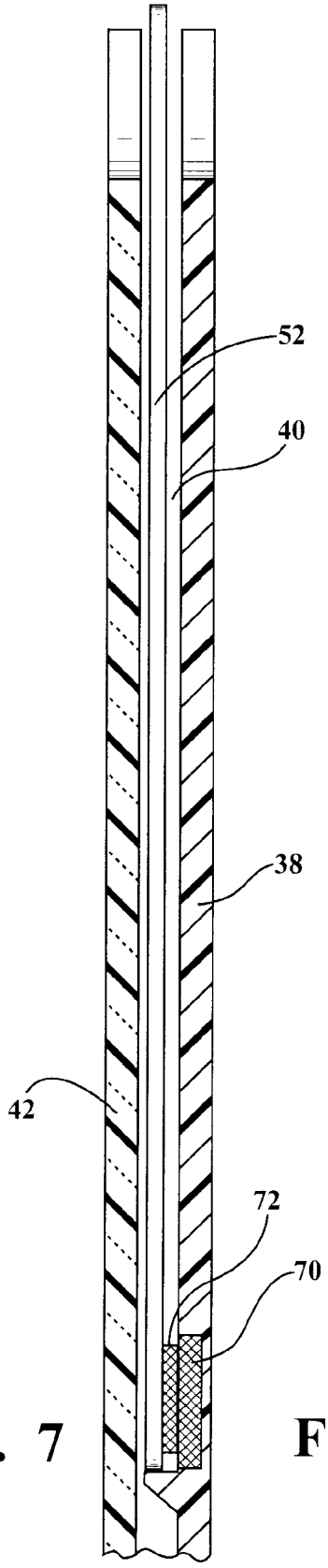
FIG. 7 is a cross-sectional view of a card position generally along line 7-7 in FIG. 5 illustrating a card retained in the card position in accordance with an aspect of the disclosure.

According to another aspect shown in FIG. 7, each card position 40 may include a magnet 70 disposed therein that can communicate with a magnet 72 associated with each card 52 to securely retain the cards 52 in their respective card position 40 while the wheel 28 is spinning. If magnets are used as the card retention mechanism, a cover over the front face of the card 52 may not be needed. The magnet 72 can be associated with the card in 52 a variety of suitable ways, including embedded therein or glued to a face thereof.

Figure 8:
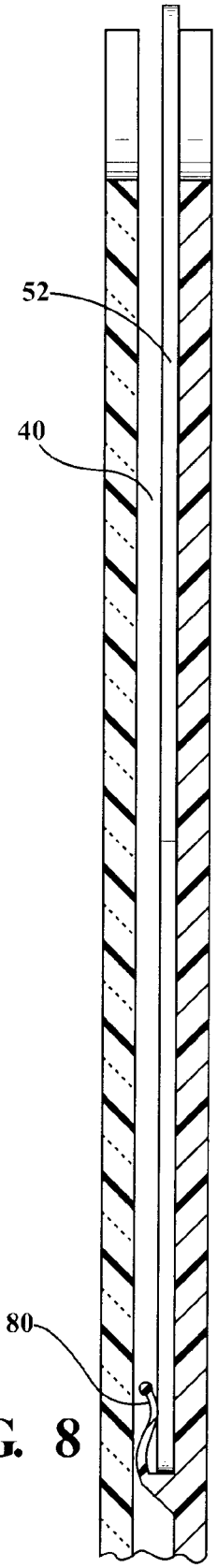
FIG. 8 is a cross-sectional view of a card position generally along lines 8-8 in FIG. 5 illustrating a card retained in the card position in accordance with another aspect of the disclosure.

According to still a further aspect shown in FIG. 8, each card position 40 may include a retaining clip 80 that is spring biased to assist in securing each card 52 firmly within each card position 40 while the wheel is spinning. It will be appreciated that the retaining clip 80 can take on a variety of different configurations. Moreover, according to yet other aspects, the card retention mechanism can take on a variety of different forms and configurations. It is of utmost importance that the cards 52 do not unintentionally fall out of the positions 40 during the spinning of the card shuffling machine 16 thus any mechanism that imparts friction to the cards 52 and keeps them in place, including the slots themselves may be employed.

The present invention provides for a casino card or other table game 10 and wherein the card shuffling machine 16 is a vertical shuffler rotationally disposed with card positions 40 that can display cards in a face up orientation. Each round of the game 10 includes the step of determining the winning card 52 by spinning the card shuffling machine 16 and allowing it 16 to come to a rest with the flapper 50 pointing at the winning card 52. In the electronic version, the indicator of the selected card would be entered into a computer (whether manually or automatically with a reader) such that the computer could resolve any wagers with players at betting terminals in communication therewith.

The present invention provides for a unique machine 16 suitable for play of casino games. The present vertical card shuffling machine 16 may, in one exemplary embodiment, include a five foot (5') diameter circular wheel 28 formed with a predetermined number of card positions 40 for holding the cards 52 disposed in a circular pattern near the wheel's rim 32. The number of positions 40 depends on the game 10 utilizing the machine 16. Thus, a wheel 28 including thirty-six card positions 40 is required for traditional craps-type games. A wheel 28 including thirty-eight positions 40 is needed for American style roulette games. And so on. The cards 52 disposed in the card positions 40 can be standard playing cards or they could be custom cards having customized indicia 54 or a customized layout.

The card shuffling machine 16 has a first flapper 48 positioned at the twelve o'clock position to slow the spinning wheel 28 and to provide an interesting clicking noise. Because the circular wheel 28 of the exemplary embodiment is so large, the dealer would have a difficult time reaching and removing the winning card 52 if it was the one at the top of the wheel 28 when it stopped spinning. To solve this problem, the card shuffling machine 16 can include a second flapper 50 at the three o'clock position, i.e. within comfortable reach of the dealer even if the dealer is confined to a wheel chair. The second flapper 50 functions to indicate the winning card 52 in addition to making noise and adding increased resistance for slowing the spinning wheel 28. Having two flappers 48, 50 slows the wheel 28 at a much faster rate than many other prize wheel games, thus providing for more rounds per hour of the game to be played. More rounds per hour suggest an increase in potential profit for the casino.

The card shuffling machine 16 is also better than the prize wheels of the prior art systems as it increases player excitement as the card indicia 54 can be seen while the wheel 28 is spinning. Also, one significant improvement of the present design relates to game protection. On a prior art prize wheel with fixed indicia, a skilled advantage player can become very proficient in what is referred to in the gaming industry as "wheel tracking". It is a proven fact that the human body exhibits a phenomenon known as muscle memory. Basketball players, tennis player and golfers are just a few professions which rely on muscle memory to replicate a desired outcome. A dealer, when spinning a big wheel is subjected to the same muscle memory science. When a player can see the numbers surrounding the point generation or outcome location, they can determine, with regular accuracy, the section of the apparatus that will come to rest in any given location. Such a player has just shifted the game from having a house advantage to a game having a player advantage which could cost the house a potentially large amount of money if not addressed. With the use of cards 52, the present invention eliminates the fixed indicia and enables the ability to reposition the cards 52 periodically to assure for random selection as it pertains to any given wager.

In summary, the vertical card shuffling machine 16 of the present disclosure overcomes the biasing and collusion problems of the prior art vertical prize wheels. In order to increase the attractiveness of the vertical card shuffling machine 16, programmable lights may be also added to the circumference of the front face 34.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A rotary card shuffling machine comprising:

a single rotary wheel, including a generally horizontal axis of rotation, the wheel having a front face with a plurality of card positions disposed adjacent an outer peripheral portion of the wheel, the total number of the plurality of card positions comprising a predetermined number, the wheel capable of free spinning rotation about the horizontal axis of rotation;

a plurality of cards, the total number of the plurality of cards being equal to the predetermined number of card positions, each of the plurality of cards being removably disposed in one of the plurality of card positions, each card bearing indicia on a front face suitable to decide an outcome of a game of chance, each of the plurality of cards being oriented on the wheel such that the indicia is parallel to the generally horizontal axis of rotation, each of the plurality of card positions is defined by a plurality of slots, each slot is configured to receive one of the plurality of cards therein, each of the slots has a transparent outer portion that allows the indicia disposed on the front face of the card to be seen, and each of the slots has a cut-out to facilitate removal of the card therefrom;

a card retention mechanism disposed inside each of the plurality of slots and associated with each of the plurality of card positions for engaging the card removably disposed in each card position; and each of the plurality of card positions configured to receive and releasably retain one of the plurality of cards such that each of the plurality of cards that are relevant to the outcome of the game of chance is visible while the rotary wheel rotates in a free spinning rotation about the generally horizontal axis of rotation and such that each of the total number of the plurality of cards is visible to each player of the game while playing the game.

2. The machine of claim 1, wherein the cut-out is a semi-circular cut-out adjacent to an upper end of each of the slots to facilitate removal of the card therefrom.

3. The machine of claim 1, wherein the card retention mechanism includes at least one hook and loop attachment mechanism inside each slot for engagement with a corresponding hook and loop attachment mechanism on each card.

4. The machine of claim 1, wherein the card retention mechanism includes a magnet inside each slot for engagement with a corresponding magnet associated with the card disposed inside the slot.

5. The machine of claim 1, wherein the card retention mechanism includes a clip inside each slot for engagement with the card disposed inside the slot.

6. The machine of claim 1, further comprising:

a support structure having an axle extending therefrom for engaging the rotary wheel to effectuate free spinning rotation about the generally vertical axis.

7. A rotary card shuffling machine comprising:

a single rotary wheel, including a generally horizontal axis of rotation, the wheel having a front face and a rear face and the wheel capable of free spinning rotation about the horizontal axis of rotation;

an annular ring and a decorative cover secured to the rotary wheel about an outer periphery thereof, the annular ring and decorative cover together forming between them a plurality of slots each for receiving a card releasably therein and the annular ring and decorative cover each including at least one notch to facilitate removal of the card from its slot, the plurality of slots and the at least one notch being disposed about the outer periphery of the annular ring and decorative cover equaling in number each possible outcome of a game of chance;

each of the slots configured to receive the card such that it can be displayed face up with an indicia of the card facing away from the front face of the wheel, such that indicia of each of the cards relevant to the outcome of the game of chance is visible as the wheel rotates in a free spinning manner;

a plurality of cards, the total number of the plurality of cards being equal to the predetermined number of the plurality of slots, the cards being removably disposed in each of the card slots, each card bearing indicia suitable to decide the outcome of a game of chance, and each of the total number of the plurality of cards is visible to each player of the game while playing the game; and a card retention mechanism disposed inside each of the plurality of slots and associated with each of the card slots for engaging the card removably disposed inside each of the card slots.

8. The machine of claim 7, wherein each of the slots has a transparent outer portion that allows the indicia of the card disposed therein to be seen.

9. The machine of claim 7, wherein the notch is a semi-circular notch adjacent to an upper end of each of the slots to facilitate removal of the card therefrom.

10. The machine of claim 7, wherein the card retention mechanism includes at least one hook and loop attachment mechanism inside each slot for engagement with a corresponding hook and loop attachment mechanism on each card.

11. The machine of claim 7, wherein the card retention mechanism includes a magnet inside each slot for engagement with a corresponding magnet associated with the card disposed inside the slot.

12. The machine of claim 7, wherein the card retention mechanism includes a clip inside each slot for engagement with the card disposed inside the slot.

13. A game of chance apparatus, comprising:

a table surface having a game layout with a plurality of wagering areas allowing for receipt of wagers on possible outcomes of a game of chance;

a card shuffling device disposed adjacent the table surface, the card shuffling device including:

a base portion for supporting the card shuffling device;

a single rotary wheel configured to rotate in a free spinning manner about a generally horizontal axis of rotation;

an upright member secured at one end to the base portion and secured at an opposing end to the rotary wheel;

the rotary wheel having a front face with a plurality of card positions disposed about an outer periphery of the wheel, the plurality of card positions totaling in number all possible outcomes of the game of chance;

the plurality of card positions including slots having a front portion formed of a transparent material, the slots configured to receive at least one card from a total number of cards which equal in number the total number of card positions; the slots being configured to receive the at least one card between the front portion and the front face of the rotary wheel, such that indicia of the at least one card can be seen through the front portion while the rotary wheel in a free spinning manner rotates about the generally horizontal axis of rotation, and the front portion of each slot having a cut-out to facilitate complete removal of the card therefrom; and a card retention mechanism disposed inside each of the plurality of slots and associated with each of the slots for releasably retaining the single card inside each of the slots during free spinning rotation of the wheel.

14. The apparatus of claim 13, wherein the cut-out is adjacent to an upper end of each slot to facilitate removal of the card therefrom.

15. The apparatus of claim 13, wherein the cut-out has a generally semi-circular shape.

16. The apparatus of claim 13, wherein the card retention mechanism consists of at least one hook and loop attachment mechanism disposed inside the slot for engagement with a corresponding hook and loop attachment mechanism on the single card disposed inside the slot.

17. The apparatus of claim 13, wherein the card retention mechanism includes a magnet disposed inside the slot for engagement with a corresponding magnet associated with the single card disposed inside the slot.

18. The apparatus of claim 13, wherein the card retention mechanism includes a clip disposed inside the slot for engagement with the single card disposed inside the slot.

* * * * *